US005616113A

United States Patent [19]

Van Den Bergh

[11] Patent Number: 5,616,113

[45] Date of Patent: Apr. 1, 1997

[54] MACHINE FOR FOLDING A WEB IN A ZIGZAG MANNER

[75] Inventor: Marc Van Den Bergh, Waasmunster, Belgium

[73] Assignee: Web Converting Equipment, naamloze vennootschap, Belgium

[21] Appl. No.: 367,354

[22] PCT Filed: Jul. 14, 1993

[86] PCT No.: PCT/BE93/00049

§ 371 Date: Jan. 17, 1995

§ 102(e) Date: Jan. 17, 1995

[87] PCT Pub. No.: WO94/02403

PCT Pub. Date: Feb. 3, 1994

[30] Foreign Application Priority Data

Jul. 15, 1992 [BE] Belgium ..... 09200661

[51] Int. Cl.[6] ..... B31B 1/52

[52] U.S. Cl. ..... 493/23; 493/8; 493/12; 493/22; 493/27; 493/29; 493/409; 493/411; 493/412; 493/413; 493/414; 493/415; 270/39.05

[58] Field of Search ..... 493/12, 16, 22, 493/27, 29, 409, 411, 412, 413, 414, 415, 8, 23; 270/39, 39.05, 39.06, 39.07, 39.08, 39.09

[56] References Cited

U.S. PATENT DOCUMENTS 4,573,670 3/1986 Felix ..... 493/413
4,597,752 7/1986 Müller et al. ..... 493/409
4,810,239 3/1989 Moss ..... 493/27
4,846,454 7/1989 Parkander ..... 493/412
5,062,597 11/1991 Martin et al. ..... 270/39
5,360,213 11/1994 Crowley et al. ..... 493/22

*Primary Examiner*—Joseph J. Hail, III
*Assistant Examiner*—Darren Ark
*Attorney, Agent, or Firm*—Bacon & Thomas

[57] ABSTRACT

Machine for folding a web (3) in a zigzag manner includes a transport mechanism (2) for the web (3), a receiving device (5) at the bottom for collecting the folded web, a folding mechanism (4) mounted between the transport mechanism (2) and the receiving device (5) and a detection device (19,20) to detect improper folds mounted under the folding mechanism (4), wherein the machine includes a device arranged to move the web (3) backward in the folding mechanism (2) and a control device (22) connected to the backward moving device and the detection means (19,20), so that, at least upon a first detection of an improper fold, the web (3) is moved backward in the folding mechanism (4) by said backward moving device over such a distance that the improper fold is entirely unfolded and so as to afterwards allow again for the normal forward movement of the web (3) through the folding mechanism (4).

17 Claims, 1 Drawing Sheet

MACHINE FOR FOLDING A WEB IN A ZIGZAG MANNER

BACKGROUND OF THE INVENTION

Field of the Invention

The invention concerns a machine for folding a web in a zigzag manner, whereby said machine contains a transport mechanism for the web, a receiving device at the bottom for collecting the folded web, a folding mechanism erected between the transport mechanism and the receiving device and a detection means to detect improper folds.

Related Art

Such machines, which may contain a cutting device or perforating device, are usually coupled to a printing machine. The web may be whether or not prefolded or, in other words, the web which is supplied to the printing machine may come from a zigzag folded stack as well as from a roll.

The printing machine/folding machine unit requires supervision and thus cannot work overnight or during weekends, when no personnel are present. From time to time, a fold is not formed correctly. Such an improper fold is detected by the detection means which then emits a signal or stops the unit. Consequently, the unit is frequently inoperative for quite some time during unattended periods, which reduces its performance and upsets the production scheme or planning.

BRIEF SUMMARY OF THE INVENTION

The invention aims to remedy this disadvantage by providing a machine for folding a web in a zigzag manner which contains a detection means for the detection of improper folds and with which improper folds in the web folded on a stack can be avoided, but with which the standstill of the machine as a result of a detected improper fold lasts significantly shorter than with the known machines.

To this aim, the folding machine contains means to move the web backward in the folding mechanism and a control device which is connected to these means and the detection means, so that, at least with a first detection of an improper fold, the web is moved backward in the folding mechanism by said means over such a distance that the improper fold is entirely unfolded and so as to afterwards allow again for the normal forward movement of the web through the folding mechanism.

When an improper fold is detected, there is an intervention, but the machine is not stopped permanently. The improper fold is unfolded and at least one new attempt for folding is made. In most cases, the folding is done normally and the machine just continues working until the next improper fold or until the folding job is completed.

The folding mechanism may contain a suspended web guide which hinges to and fro in the usual manner, means to hinge this guide to and fro and smoothing means for smoothing the folds of the web put down in a zigzag manner by the guide.

According to a special embodiment of the invention, the means for moving the wed backward are means to reverse the driving direction of the transport mechanism and the control device contains means to, as an improper fold is detected, order said means for reversing the driving direction to temporarily reverse the driving direction of the transport mechanism such that this transport mechanism itself moves the web backward.

The transport mechanism may hereby either contain pin tractors or a driven roller working in conjunction with a counter roller According to another special embodiment of the invention, the means for moving the web backward consist of separate driving means which can be switched on and off which can move the web backward.

According to this embodiment, the control device can selectively stop the transport mechanism or even reverse its driving direction when the driving means which move the wed backward are activated. Except when the driving direction is reversed, a buffer should be provided between the transport mechanism and the driving means in which an amount of the web can be stored, whereby said buffer should of course be larger in case the transport mechanism just continues working than when it is brought to a standstill.

According to a practical embodiment, the machine contains a cross cutting mechanism for cutting the web, whereas the control device contains means to control the cross cutting mechanism such that, after having activated the means to move the web backward a predetermined number of times, after successive detections of an improper fold by the detection means, it either cuts the web after the improper fold, or the part of the web with the improper form is cut off, after which the machine reassumes its normal operation.

Other characteristics and advantages of the invention will become clear from the following description of a machine for folding a web in a zigzag manner according to the invention. This description is given by way of example only and without being limitative in any way.

BRIEF DESCRIPTION OF THE DRAWING

The figures refer to the accompanying drawings where.

DETAILED DESCRIPTION

Figure 1:
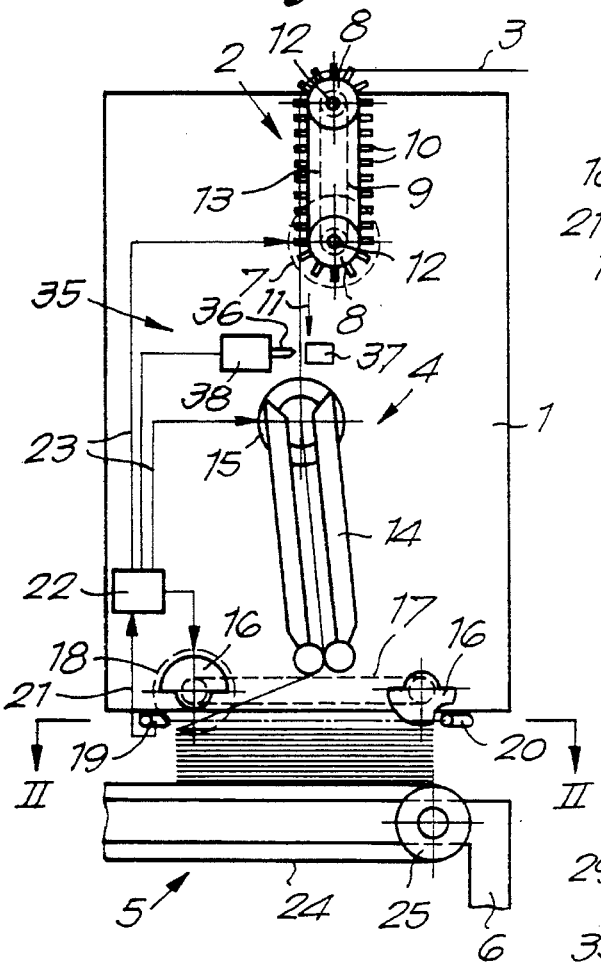
FIG. 1 shows a schematic side view of a machine for folding a web in a zigzag manner according to the invention.
Figure 3:
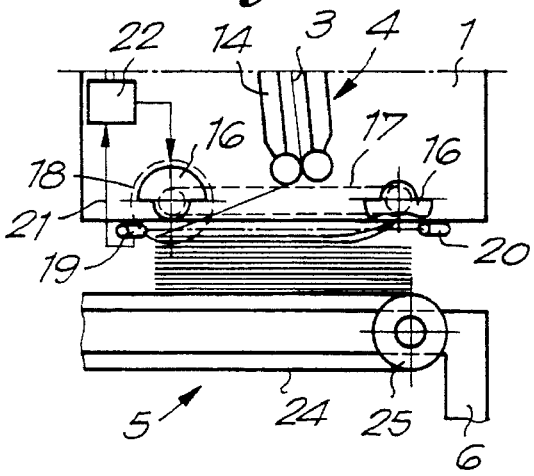
FIG. 3 shows the lower part of a side view analogous to that in FIG. 1, but after an improper fold was made.
Figure 2:
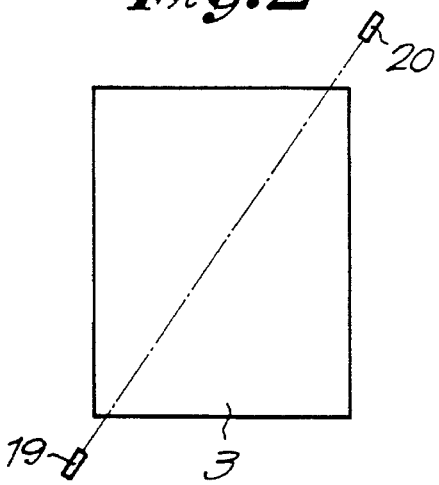
FIG. 2 shows a cross section according to line II—II from FIG. 1.

The folding machine represented in FIGS. 1 to 3 contains a frame 1, a transport mechanism 2 for a web 3 mounted upon it, a folding mechanism 4 mounted under this mechanism 2 on the frame 1 and a receiving device 5 which is mounted under this folding mechanism 4 on a separate frame 6. The frames 1 and 6 and thus also the folding mechanism 4 and the receiving device 5 can be adjusted in height with regard to one another, for example by means of cylinder/suction mechanisms.

The web 3 is made of paper and is printed in a printing machine onto which the folding machine is connected via a buffer. This web may be selectively prefolded and/or provided with perforations according to lines directed in the transverse direction. Along both longitudinal edges, the web 3 is provided with round openings for transport. Also, the transport mechanism 2 contains two pin tractors, one for each edge of the web 3, which are driven by one and the same stepping motor 7 with reversible driving direction.

Each pin tractor consists of two wheels 8 over which a belt 9 runs which is provided with pins 10 pointed outwards and fitting in the above-mentioned openings. The wheels 8 of the two pin tractors situated in front and in the back respectively with regard to the normal forward transport direction which is represented in FIG. 1 by means of the arrow 11, are mounted on one and the same axis 12. The two axes 12 are interconnected via a geared belt transmission 13.

The folding mechanism 4 contains a web guide 14 forming a slit in the usual manner which is suspended to the frame 1 hinging to and fro with its top side pivoting around a horizontal axis of rotation. Means to hinge this web guide 14 to and fro consist of an electrical motor 15 mounted on the frame 1 which alternately runs in either direction. Under the web guide 14 are mounted smoothing means which consist of two sets of semicircular-shaped flattening brushes 16 which are mounted on the frame 1 in a rotatable manner around horizontal axes which are parallel to the pivot of the guide 14. The flattening brushes 16 of either set are turned 180 degrees with regard to the flattening brushes 16 of the other set, but they are driven synchronously by means of an electrical motor 18 via a geared belt transmission 17.

Just above the bottom side of the flattening brushes in their downward reversed position, a detection means has been erected for the detection of improper folds, which consists of a photoelectric cell 19 and a light source 20 which are erected in a horizontal field but diametrically opposed to one another with regard to a smoothed sheet of the folded web 3, as is clearly represented in FIG. 2. When the fold is correct, this smoothed sheet will be perfectly horizontal and will not interrupt the beam of the light source 20. When an improper fold is made, this constitutes a thickening and the beam is interrupted. The photoelectric cell 19 is connected to a control device 22 via an electrical line 21 which is connected to the motors 7, 15 and 18 via electrical lines 23.

The receiving device 5 consists of an endless belt 24 which runs over rolls 25 borne in the frame 6 which are intermittently driven by a motor which is not represented in the drawings.

Between the transport mechanism 2 and the folding mechanism 4, a cross cutting mechanism 35 is mounted on the frame 1 with a moveable cutting knife 36 which can be moved with regard to a stationary beam 37, for example by means of a cylinder/suction mechanism 38 which is connected to the control device 22.

The folding mechanism works as follows:

When the machine is started the control device 22 orders the motors 7, 15 and 18 to start. As a result, the web 3 is continuously moved in the sense of the arrow 11 by means of the driven pin tractors and supplied into the slit of the web guide 14 rotating to and fro. This guide 14 puts down the wed 13 in a zigzag manner on the stationary endless belt 24 or on a part of the web 3 which has already been folded and which is stacked on this belt 24. The flattening brushes 16 smooth the folds.

As the stack of already folded web 3 becomes higher, the frame 1 is raised with regard to the frame 6, such that the flattening brushes 16 are always at the height of the top side of the stack and can smooth the folds with the required pressure. When the stack is high enough, a roller 25 is temporarily driven and the stack is moved away from under the folding mechanism 4 with the belt 24. By means of the cross cutting mechanism 35 or another cutting mechanism, the web 3 can be cut after each stack.

Each time a fold has been smoothed, the detection means 19,20 carries out a detection and if, after a fold has been smoothed, the beam in between the light source 20 and the photoelectric cell 19 is interrupted because the fold was not correctly made, as represented in FIG. 3 where, for clarity's sake, the right flattening brush 16 has been partly cut out, this detection means 19,20 sends a signal to the control device 22. This control device 22 is designed such that, as it receives said signal, it stops the motors 15 and 18 when the guide 14 is in its middlemost, vertical position, and does not only stop the motor 7, but makes it turn in the backward driving direction. Consequently, the web 3 is moved backward and among other the improper fold is unfolded again. To this end, the control device 22 contains means which may consist of an electronic circuit so as to reverse the driving direction of the motor 7.

The control device contains means which, when the web was moved backward over some three page lengths, i.e. about three distances between two successive folding spots, order the motor 7 to reverse its driving direction again and order the motors 15 and 18 to start such that the folding machine reassumes its normal working order and tries to fold again the part in which the improper fold occurred. If this is successful, the machine just continues working. If, however, an improper fold is formed again, the detection means 19,20 again sends a signal to the control device 22 and the above-described backward movement of the web and the attempt to correct the fold is repeated.

The control device 22 is designed such that it can have the same part of the web 3 folded again for a preset number of times, for example three times. Only if, after these attempts for correction, an improper fold still occurs in the same page of the web 3, the control device 22 will order the attempts to be stopped and will send a signal to the cylinder/suction mechanism 38 of the cross cutting device 35, such that this cross cutting device 35 crosswise cuts off the web 3 after the improper fold. Subsequently, the machine reassumes its normal operation. Later, when the folded stacks are used, an improper fold can be spotted immediately, since the web of the stack is interrupted there.

Improper folds are automatically corrected or, if this does not work, the web is cut such that the machine does not come to a lengthy standstill due to an improper fold until an operator intervenes. Hence, the machine can carry out the entire folding job without the presence of an operator being required.

According to a variant it is even possible for the cross cutting mechanism to cut off the part with the improper fold, after which this part is removed by means of a conveyor mechanism in this case the control device 22 controls the transport mechanism 2 and the cross cutting mechanism 35 such that, after a certain number of correction attempts after the detection of an improper fold, said cross cutting mechanism 35 cuts through the web 3 a first time after a backward movement of the web 3 and a second time after a new forward movement over the same distance, after which the control device 22 orders the conveyor mechanism to remove the cut-off web part.

According to a simplified variant of this embodiment, the control device 22 does not order the cutting off of a part of the web 3, such that no cutting mechanism 35 is required to this end, but, if after a certain number of correction attempts an improper fold is still detected, the control device 22 will emit an alarm signal and stop the entire folding machine and possibly also the printing machine working in conjunction with it. Said alarm signal may be a visual signal and/or an audible signal.

It is clear that, as one or several correction attempts are made with an improper fold, the number of complete standstills of the machine until an operator intervenes, is very limited.

According to another variant of the above-described embodiments, the control device 22 keeps the motors 15 and 18 running during the backward movement of the web 3.

Figure 4:
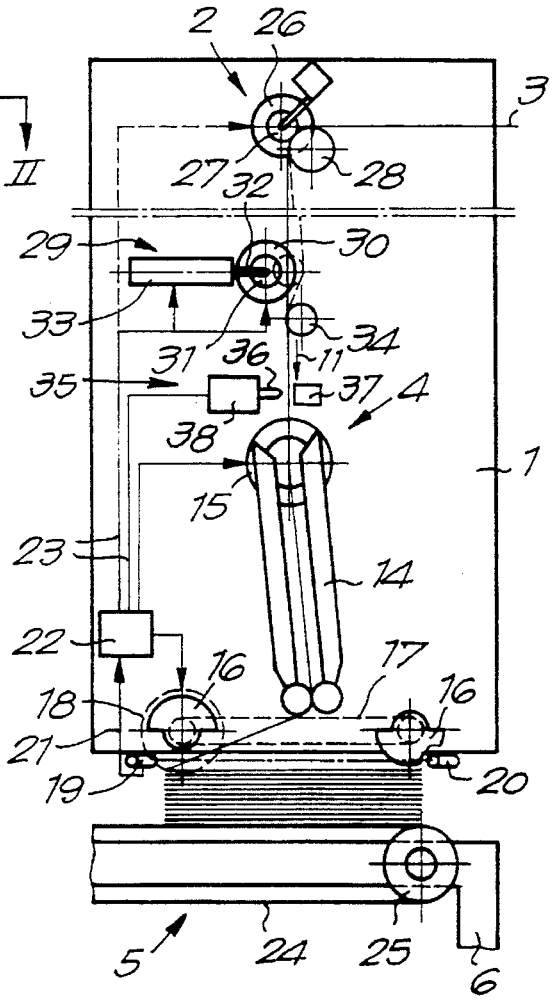
FIG. 4 shows a schematic side view analogous to that in FIG. 1, but with reference to another embodiment of the machine according to the invention.

The embodiment of the folding machine to which FIG. 4 refers differs from the embodiment represented in FIGS. 1 to 3, mainly because the transport mechanism 2 has no pin tractors but a roller 27 borne in the frame 1 driven by a motor 26 and a counter roller 28 borne in a somewhat resilient manner in said frame, and because the means to move the web 3 backward contain separate driving means 29.

These driving means 29 consist of a roller 31 driven by a motor 30 which is mounted at the end of a piston rod 32 of a cylinder/suction mechanism 33 and can consequently be moved horizontally up against the web 3. These driving means 29 are controlled by the control device 22 such that, when the detection means 19,20 detects an improperly formed fold, said control device 22 orders the cylinder/suction mechanism 33 to slide out and the motor 30 to start, such that the driven roller 31 ends up against the web 3 and drives this web 3, which is pressed against a loosely turning roller 34, backward over the required distance.

Since the roller 31 only drives the web 3 as the cylinder/suction mechanism is slid out, the motor 30, according to a variant, may be continuously working.

While the web 3 is driven backward, the control device 22 may selectively order the motor 26 to stop. Between the driving means 29 and the transport mechanism 2, a space or buffer should be provided to receive the part of the web 3 which has been moved backward, whereby said buffer should of course be bigger if the transport mechanism 2 continues to supply the web 3.

If the motor 26 has a reversible driving sense, the control device 22 may contain means according to a variant, for example an electronic circuit, to reverse the driving sense of the motor 26 during the driving by the driving means 29. In this case, no buffer is required between the driving means 29 and the transport mechanism 2, but between the folding machine and the printing machine.

The embodiment according to FIG. 4 and the variants thereof allow for a correction of an improper fold in an analogous manner as the above-described embodiments; their working is analogous and thus they offer the same advantages.

The invention is in no way limited to the embodiments described above; on the contrary, many modifications can be made to these embodiments, among others as far as form, composition, arrangement and the number of parts used for the realization of the invention are concerned, while still remaining within the scope of the invention.

In particular, the transport mechanism must not necessarily consist of pin tractors or rollers.

If the means to move the web backward over a distance are separate driving means, they must not necessarily consist of a moveable driving roller.

The detection means must not necessarily consist of a photoelectric cell and a light source either.

Insofar as the machine contains a cross cutting mechanism, this must not necessarily be of the described type either. It may for example be a cutting mechanism with a rolling cutting wheel. The cutting mechanism may for example move along with the web, such that the web does need to be stopped during the cutting.

Moreover, the machine may also contain a longitudinal cutting mechanism to cut off the edges provided with openings after the transport mechanism, or it may contain a cross perforating mechanism.

I claim:

1. Machine for folding a web (3) in a zigzag manner to produce connected folded pages comprising a transport mechanism (2) for a web (3), a receiving device (5) at a bottom area of the machine for collecting the folded web, a folding mechanism (4) disposed between the transport mechanism (2) and the receiving device (5) and a detection means (19,20) to detect an improper fold disposed downstream from the folding mechanism (4) in the direction of forward web motion, means to move a web (3) backward in the folding mechanism (2) and a control device (22) connected to said means to move the web backward and the detection means (19,20), said control device arranged such that, at least upon the occurrence of a first detection of an improper fold by said detection means, the means for moving the web (3) backward in the folding mechanism (4) is actuated by said control device over such a distance that the improper fold is entirely unfolded and such that whereupon such unfolding the normal forward movement of the web (3) through the folding mechanism (4) is continued.

2. Machine according to claim 1, wherein the folding mechanism (4) includes a suspended web guide (14) mounted so as to pivot to and fro to put down the web in a zigzag manner in the receiver, means (15) to hinge said guide (14) for to and fro motion and smoothing means (16) for smoothing the folds of the web (3) put down in a zigzag manner by said guide (14).

3. Machine according to claim 1, wherein said means for moving the web backward comprises means to reverse the driving direction of the transport mechanism (2) and said control device (22) includes means to, when an improper fold is detected by said detection means, cause actuation of said means to reverse the driving direction of said transport mechanism (2) such that the transport mechanism (2) moves the web backward.

4. Machine according to claim 3, wherein said transport mechanism (2) contains pin tractors (7-10, 12, 13).

5. Machine according to claim 3, wherein said transport mechanism (2) comprises a driven roller (27) and a cooperating counter roller (28).

6. Machine according to claim 1, wherein said means for moving the web backward comprises an independent driving means (29) which is arranged to be switchable on and off to move the web (3) backward.

7. Machine according to claim 6, wherein said control device (22) includes means for switching off the transport mechanism (2) when the independent driving means (29) is actuated.

8. Machine according to claim 6, wherein said control device (22) includes means to reverse the driving direction of the transport mechanism (2) when the means (29) to drive the web (3) backward is actuated.

9. Machine according to claim 1 wherein said control device (22) includes means to move the web (3) backward in the folding mechanism (2) such that during the backward movement of the web (3), the web is moved backward over a distance of two to three pages.

10. Machine according to claim 1, wherein said control device (22) includes means to emit a signal after having actuated the means to move the web (3) backward a predetermined number of times after successive detections by the detection means (19,20) of an improper fold at one and the same page of the web (3).

11. Machine according to claim 1, wherein said control device (22) includes means to stop the machine after having actuated the means to move the web (3) backward a predetermined number of times after successive detections by the detection means (19,20) of an improper fold at one and the same page of the web (3).

12. Machine according to claim 1, including a cross cutting mechanism (35) for cutting the web (3), and wherein said control device (22) includes means to control the cross cutting mechanism (35) such that, after having actuated the means to move the web (3) backward after a predetermined number of times, after successive detections of an improper fold by the detection means (19,20), the cross cutting means is activated to cut the web (3) after the improper fold, whereupon the machine resumes its normal operation.

13. Machine according to claim 1, including a cross cutting mechanism (35) for cutting the web (3), and wherein the control device (22) includes means to control the cross cutting mechanism (35) such that, after having actuated the means to move the web (3) backward after a predetermined number of times after successive detections of an improper fold by the detection means (19,20), the cross cutting mechanism is actuated by the control means to cause the pan of the web (3) with the improper fold is to be cut off, and whereupon the machine resumes its normal operation.

14. A method of clearing a mis-folded web in a machine for folding a web in a zigzag manner to produce connected folded pages, the machine including a transport mechanism (2) for advancing a web (3) in a forward direction, a receiving device (5) at a bottom area of the machine for collecting the advanced folded web, a folding mechanism (4) disposed between the transport mechanism (2) and a receiving device (5), a mis-fold detection device (19,20) for detecting an improper fold in the web, a device for reversing the direction of advancement of the web in the folding mechanism, and a control device (22) connected to the device for reversing the direction of advancement of the web and the mis-fold detection device, comprising:

advancing the web forwardly until a mis-fold occurs;

detecting a mis-fold in the web; and then actuating the device for reversing the direction of advancement of the web to reverse the web advancement until the mis-fold is entirely unfolded; and then restoring the forward advancement of the web.

15. The method according to claim 14, wherein the device for reversing the advancement direction of the web is the transport mechanism, and the step of actuating the device for reversing the direction of advancement of the web includes actuating the transport mechanism in the reverse direction.

16. The method of claim 14, including detecting a predetermined number of improper folds in succession at the same page fold; and then stopping the machine.

17. The method according to claim 14, including detecting a predetermined number of improper folds in succession at the same page fold; and then cutting the web above the improper fold, and then restoring the forward advancement of the web.

* * * * *